US005459550A

United States Patent [19]

Fyson et al.

[11] Patent Number: 5,459,550

[45] Date of Patent: Oct. 17, 1995

[54] PHOTOGRAPHIC PROCESSING APPARATUS

[75] Inventors: John R. Fyson; Edward C. T. S. Glover, both of London, United Kingdom

[73] Assignee: Eastman Kodak Company, Rochester, N.Y.

[21] Appl. No.: 244,531

[22] PCT Filed: Nov. 25, 1992

[86] PCT No.: PCT/EP92/02708

§ 371 Date: May 27, 1994

§ 102(e) Date: May 27, 1994

[87] PCT Pub. No.: WO93/11463

PCT Pub. Date: Jun. 10, 1993

[30] Foreign Application Priority Data

Nov. 28, 1991 [GB] United Kingdom ..... 9125299

[51] Int. Cl.[6] ..... G03D 3/02; G03D 3/04

[52] U.S. Cl. ..... 354/325; 354/330

[58] Field of Search ..... 354/317–323, 354/331, 336, 339, 329, 330, 325

[56] References Cited

U.S. PATENT DOCUMENTS

| | | | |
|---|---|---|---|
| 2,605,684 | 8/1952 | Nagels et al. | 354/318 |
| 2,861,508 | 11/1958 | Baumbach et al. | 354/317 |
| 3,595,156 | 7/1971 | Zimmerman | 354/323 |
| 3,673,985 | 7/1972 | Dols | 354/329 X |
| 3,943,541 | 3/1976 | Hirafuji | 354/317 X |
| 4,187,022 | 2/1980 | Walter | 354/318 |
| 4,613,223 | 9/1986 | Cherry et al. . | |
| 4,954,425 | 9/1990 | Iwano | 430/373 |

FOREIGN PATENT DOCUMENTS

| | | | |
|---|---|---|---|
| 654204 | 1/1963 | Canada | 354/329 |
| 2344913 | 3/1975 | Germany . | |
| 2552942 | 6/1976 | Germany . | |
| 370680 | 4/1939 | Italy | 354/329 |

*Primary Examiner*—D. Rutledge

*Attorney, Agent, or Firm*—Nixon, Hargrave, Devans & Doyle

[57] ABSTRACT

A photographic processing apparatus for processing photographic material including a drum rotatable about an axis and forming a drum-material interface with the material being processed, at least one reservoir for storing processing solution, and application means for applying processing solution to the surface of the drum for transmittal to the material being processed. The apparatus being characterized in that the surface of the drum has at least one spiral form thereon along its length to distribute processing solution at least along the length of the drum-material interface, each spiral having an axis which lies substantial coincident with the axis of the drum.

13 Claims, 3 Drawing Sheets

PHOTOGRAPHIC PROCESSING APPARATUS

FIELD OF THE INVENTION

This invention relates to photographic processing apparatus and is more particularly concerned with the processing of small areas of photographic material, for example, prints on photographic paper.

BACKGROUND OF THE INVENTION

It is well-known to use rotating drums in photographic processing apparatus. US-A-4 613 223 discloses an arrangement in which a flexible sheet of photographic material is driven along an endless curved path within a processing tank by passing the sheet through nips formed between at least one pair of driven rollers. At least one of the driven rollers is the drum itself. During processing, the emulsion (sensitive) surface of the sheet is arranged not to come into contact with any stationary part of the processing vessel as it is being processed. This prevents damage to the surface during processing. After driving the sheet around the endless path for a predetermined number of cycles, which defines the processing time, the sheet is then directed out of the processing tank.

The arrangement described above, has the disadvantage that little or no agitation is applied to the emulsion surface of the photographic material being processed. This may result in uneven processing of the material and variable sensitometry.

Furthermore, relatively large volumes of processing solution are required which makes the arrangement disclosed unsuitable for unstable processing chemistry and single use chemistry as large volumes of processing solutions need to be discarded on a regular basis.

U.S. Pat. No. 2 605 684 discloses an arrangement in which helically wound grooves formed on rollers are used to transfer processing solution from a reservoir and to apply the solution to photographic material being processed. A small portion of the surface of each grooved roller is used to effect such transfer and application.

SUMMARY OF THE INVENTION

U.S. Pat. No. 3 943 541 discloses an arrangement in which a helically grooved roller is used to apply processing solution to photographic material being processed. In this arrangement, processing solution is applied to the surface of the roller from a tank, the material being processed passing over the tank and then roller in turn during processing.

Co-pending British Patent Application No. 9125297.3 (now published International Patent Application No. WO93/11464) discloses a rotating drum arrangement in which low volumes of processing solutions are used allowing unstable and single use chemistry to be efficiently used.

It is an object of the present invention to provide a drum surface for use in the apparatus discussed above which improves the results obtained during processing.

According to one aspect of the present invention, there is provided photographic processing apparatus for processing photographic material, the apparatus comprising a drum rotatable about an axis and having a surface with at least one helically wound groove formed thereon, the or each helically wound groove having an axis which lies substantially coincident with the axis of the drum;

at least one reservoir for storing processing solution; and application means for applying processing solution to the surface of the drum for transmittal to the material being processed;

characterized in that the material being processed passes around a substantial portion of the drum surface during processing forming a drum-material interface and in that the or each helically wound groove operates to distribute processing solution at least along the length of the drum-material interface.

In one embodiment of the present invention, one reservoir is provided and comprises a processing tank surrounding at least a part of the drum. In this case, the application means comprises the reservoir.

Alternatively, the application means may comprise at least one feed orifice connected to the at least one reservoir for applying processing solution to the surface of the drum.

In a second embodiment of the present invention, a single feed orifice is provided which is positioned at one end of the drum. In this case, the spiral moves the processing solution from the one end to the other of the drum.

The single feed orifice may be positioned at the centre of the drum. In this case, two spirals are provided which extend in opposite directions from the centre of the drum.

The spiral may be formed as a groove cut into the surface of the drum. Alternatively, the spiral may be formed as a raised portion on the surface of the drum.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
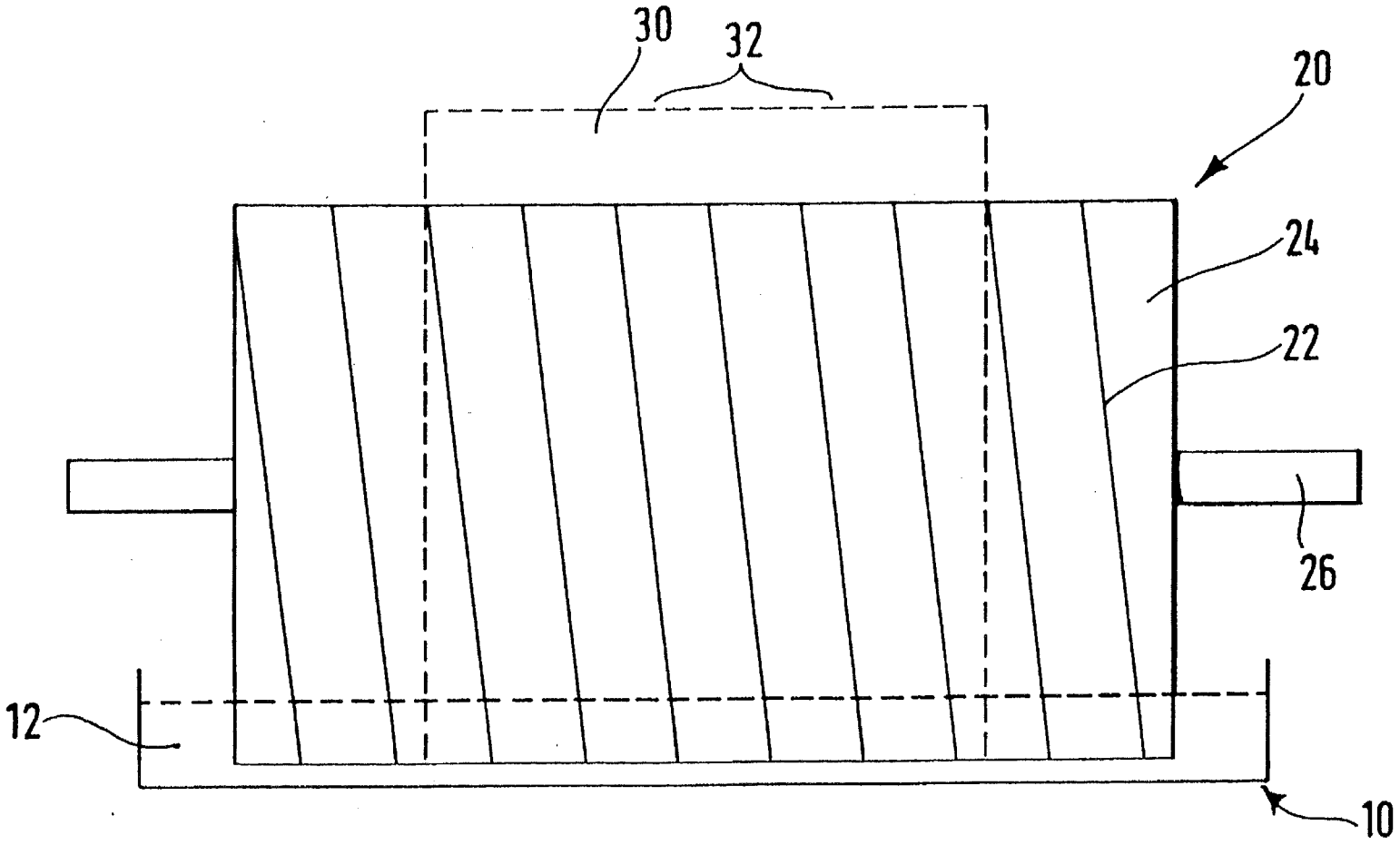
FIG. 1 is a schematic illustration of a first embodiment of a drum constructed in accordance with the present invention.

Co-pending British Patent Application No. 9125297.3 discloses a processing stage of photographic processing apparatus comprising a generally U-shaped processing tank with a central rotatable drum mounted in the tank to produce a clearance between the tank and the drum which defines the tank volume. This clearance is less than 5 mm, and preferably, less than 2 mm. In the specific example described, the clearance is approximately 1 mm. Processing solution is contained in the tank, and the material to be processed is driven through the solution at a rate which ensures that processing is complete by the time the material leaves the tank.

Two pairs of rollers are respectively positioned at the inlet and the outlet of the tank. Photographic material, for example, photographic paper, is fed into the tank by one pair of drive rollers at the inlet, passes around half of the drum and then out of the tank and through the other pair of rollers. The rollers positioned at the outlet may be squeegee rollers to remove excess processing solution from the material before it passes to the next stage of the apparatus.

The inlet rollers drive the material through the processing tank at a rate to ensure that processing is completed in the time that the material passes from the inlet rollers, through the tank 10 and out through the outlet rollers. The time during which the material is processed is determined by the speed of the inlet roller pair.

It had previously been determined that by applying a pattern to the surface of the drum, it was possible to reduce the adherence of the photographic material to the surface of the drum. Furthermore, the pattern assisted in distributing the processing solution over the material. One pattern found to be particular effective is a spiral applied either on to the surface of the drum or cut into the surface itself.

Specific process examples were carried out to evaluate the effectiveness of a spiral on the surface of the drum. In each example, the following were set:

1) the speed of the inlet rollers to give a development time of 30s; and 2) the temperature of the processing solution 30 to be 38° C.

In each case, a stop bath was positioned to receive the processed paper as it left the outlet rollers and comprised a tray containing 5% acetic acid. The tank was filled with redox amplification (RX) developer having the following composition:

| Component | Amount |
|---|---|
| CD3 | 3.5g |
| potassium carbonate | 25.0g |
| Anti-cal No. 8 | 1.0g |
| Anti-cal No. 5 | 1.0g |
| potassium chloride | 1.0g |
| water to | 1.0l |
| pH adjusted to 10.3 | |

Four examples of modifications were made to the surface of the drum to provide it with a spiral. The first three modifications involved applying a spiral to the surface of the drum and in the fourth case, a groove was cut into the drum surface. A fifth example was also tested, as a control, that is, the unmodified drum. The examples were as given in Table 1:

TABLE 1

| Example | Modification |
|---|---|
| 1 | 0.3 mm diameter fishing line to form a spiral with a pitch of 5 cm |
| 2 | 3-strand 'Laystrate' stainless steel wire to form a spiral with a pitch of 1 cm, and then sprayed with clear lacquer and allowed to dry overnight |
| 3 | 2 cm wide waterproof cloth tape to form a spiral with a pitch of 3 cm |
| 4 | a spiral groove 254 μm (0.010") deep cut, with a pitch of 1 cm |
| 5 | none |

Sheets of RX processable paper containing 14 mg/ft$^2$ silver with Ektacolor 2001 structure were exposed to wedges and even fields of light and then passed through the processing stage as described above for each example listed above. Fresh developer solution was used for each sheet of paper.

It was found that Examples 1 to 4 gave even processing, whereas Example 5 showed areas on the print in which little or no processing had taken place.

The average maximum densities of the processed wedges were as listed in Table 2:

TABLE 2

| Example | Red | Green | Blue |
|---|---|---|---|
| 1 | 2.50 | 2.61 | 2.43 |
| 2 | 2.54 | 2.60 | 2.45 |
| 3 | 2.40 | 2.51 | 2.34 |
| 4 | 2.45 | 2.51 | 2.40 |
| 5 | 1.91 | 1.95 | 1.21 |

It can be seen from Table 2 that the spiral modifications produced improved process activity and uniformity.

In FIG. 1, a processing tank 10 is shown in which a rotatable drum 20 is located. The drum 20 has a spiral 22 formed on its surface 24 and is mounted for rotation about its axis 26. Solution 12 is retained in the tank 10 as shown. A piece of material 30 to be processed is shown in dotted lines and extends around a substantial part of the surface 24 of the drum 20.

In operation, processing solution 12 is transported along the surface 24 by means of the spiral 22 formed thereon. This ensures that the central portion 32 of the material 30 receives adequate solution to effect processing.

Figure 2:
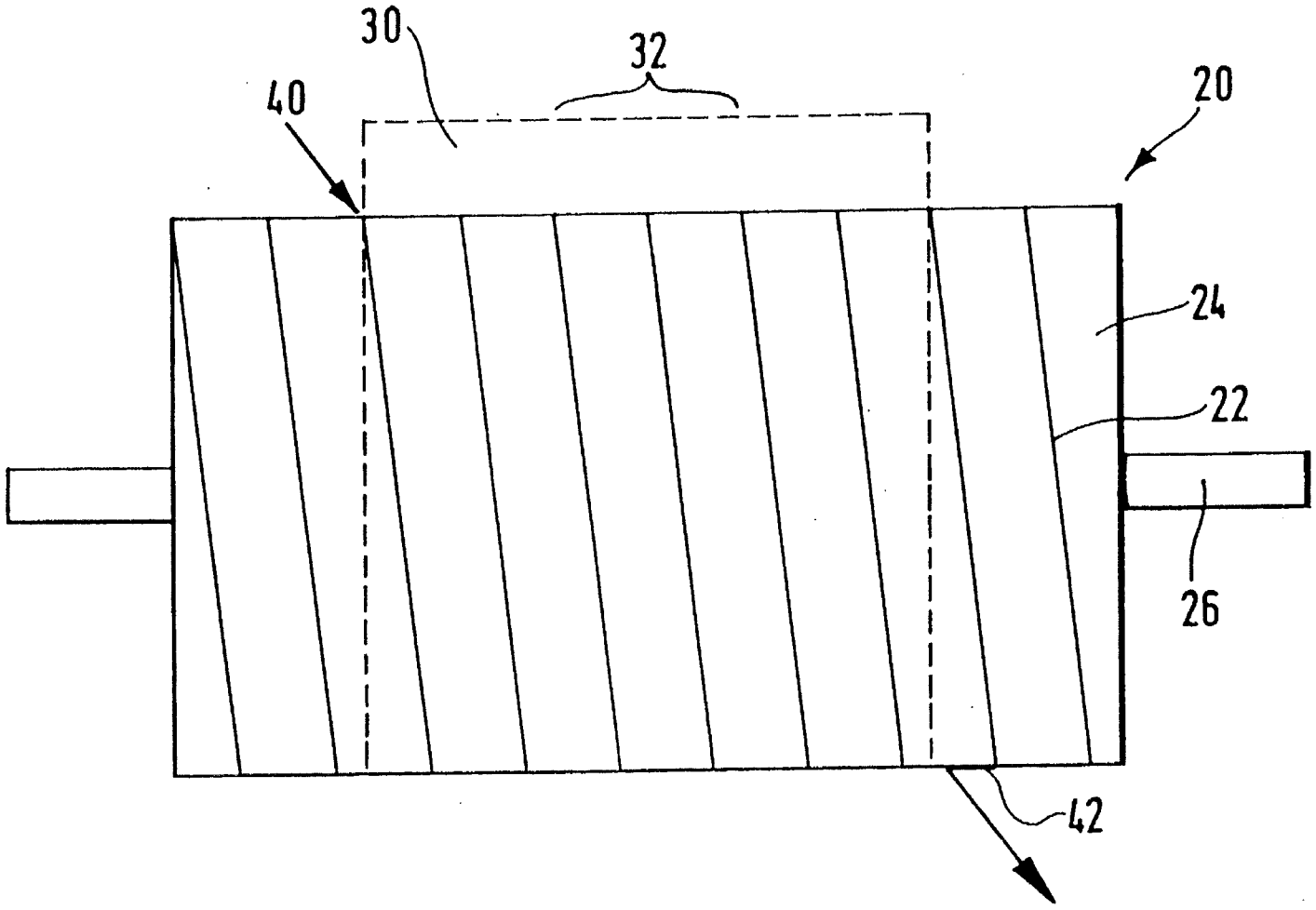
FIG. 2 is a schematic illustration of a second embodiment of a drum constructed in accordance with the present invention.

In FIG. 2, a drum identical to that shown in FIG. 1 is utilized and bears the same reference numerals. Other parts already described also bear the same reference numerals. In this embodiment, there is no processing tank for retaining the processing solution. Instead, an inlet orifice 40 is positioned above the surface 24 of the drum 20 which is connected to a reservoir of processing solution (not shown). An outlet orifice 42 is provided to remove processing solution for recirculation and replenishment (not shown). Both inlet and outlet orifices 40, 42 may be formed as part of a vessel surrounding the drum 20, or alternatively, they may simply comprise one or more appropriately positioned nozzles or jets.

In this case, processing solution is pumped through orifice 40 on to surface 24. As in the embodiment described with reference to FIG. 1, the processing solution is transported across the surface 24 by the spiral 22.

Figure 3:
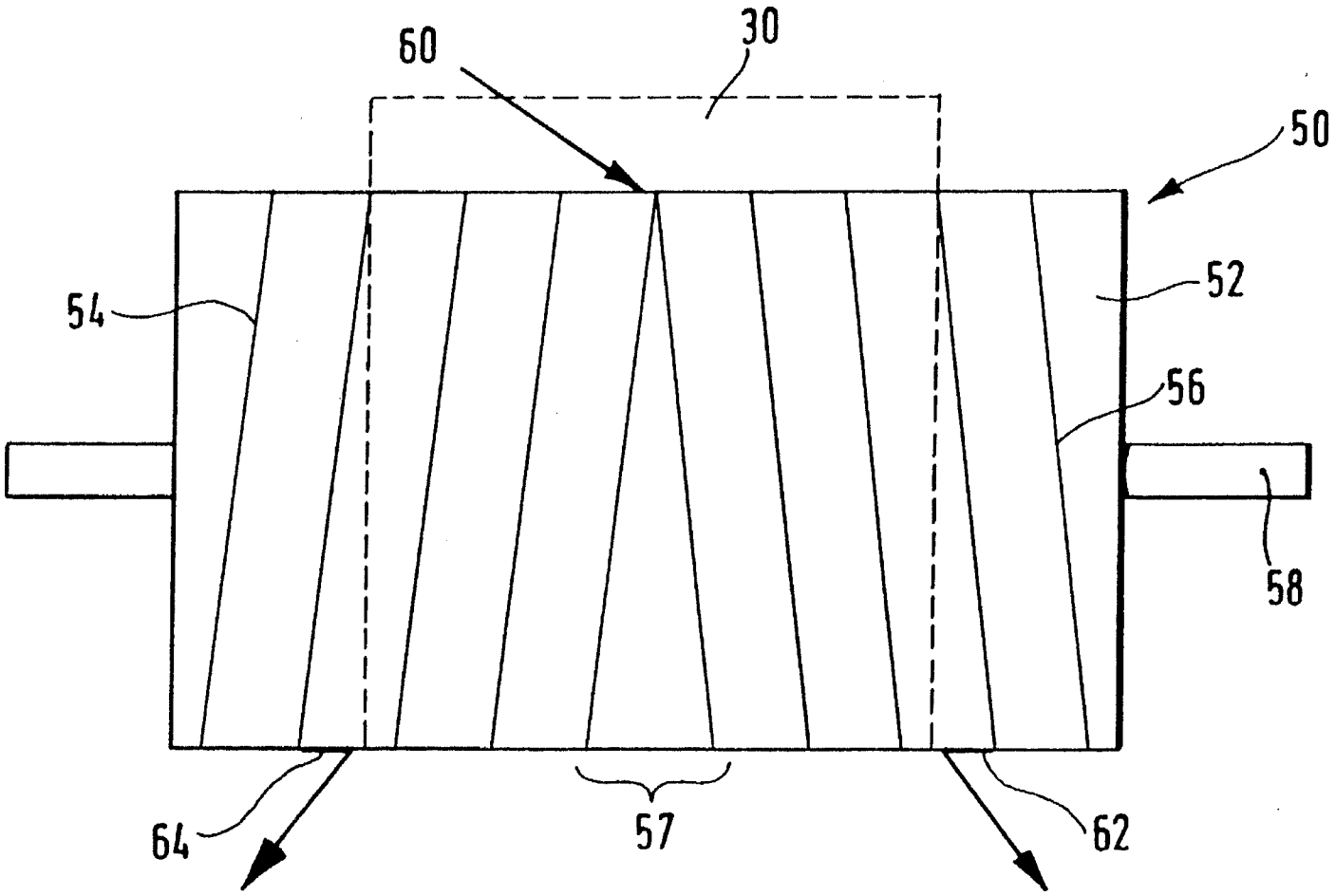
FIG. 3 is a schematic illustration of a third embodiment of a drum constructed in accordance with the present invention.

FIG. 3 illustrates a drum 50 having a surface 52 on which two opposed spirals 54, 56 which extend outwards from a central area 57 of the drum, are formed. The drum 50 is rotated about its axis 58. In this case, an inlet orifice 60 is positioned substantially at the central area 57 so that the processing solution applied thereto is transported outwards to the edge areas of the drum. Two outlet orifices 62, 64 are provided to remove processing solution for recirculation and replenishment as described above.

In the embodiments illustrated in FIGS. 2 and 3, a vessel (not shown) may be provided external to the respective drums 20, 50 to ensure that there is no spillage or leakage of processing solution.

We claim:

1. Photographic processing apparatus for processing photographic material, the apparatus comprising:

a drum rotatable about an axis and having a surface with at least one helically wound groove formed thereon, the or each helically wound groove having an axis which lies substantially coincident with the axis of the drum;

at least one reservoir for storing processing solution; and application means for applying processing solution to the surface of the drum for transmittal to the material being processed;

characterized in that the material being processed passes around a substantial portion of the drum surface during processing forming a drum-material interface and in that the or each helically wound groove operates to distribute processing solution at least along the length of the drum-material interface, wherein the application means comprises at least one feed orifice connected to the at least one reservoir for applying processing solution to the surface of the drum and wherein a single feed orifice is provided which is positioned at one end of the drum.

2. Apparatus according to claim 1, wherein one reservoir is provided and which comprises a processing tank surrounding at least a part of the drum.

3. Apparatus according to claim 2, wherein the application means comprises the reservoir.

4. Apparatus according to claim 1, further including at least one drain orifice for removing processing solution from the vicinity of the drum.

5. Apparatus according to claim 1, wherein the or each helically wound groove is formed as a groove cut into the surface of the drum.

6. Apparatus according to claim 1, wherein the or each helically wound groove is formed as a raised portion on the surface of the drum.

7. Photographic processing apparatus for processing photographic material, the apparatus comprising:

a drum rotatable about an axis and having a surface with at least one helically wound groove formed thereon, the or each helically wound groove having an axis which lies substantially coincident with the axis of the drum;

at least one reservoir for storing processing solution; and application means for applying processing solution to the surface of the drum for transmittal to the material being processed;

characterized in that the material being processed passes around a substantial portion of the drum surface during processing forming a drum-material interface and in that the or each helically wound groove operates to distribute processing solution at least along the length of the drum-material interface, wherein the application means comprises at least one feed orifice connected to the at least one reservoir for applying processing solution to the surface of the drum and wherein a single feed orifice is provided which is positioned at the centre of the drum.

8. Apparatus according to claim 7, wherein one reservoir is provided and which comprises a processing tank surrounding at least a part of the drum.

9. Apparatus according to claim 8, wherein the application means comprises the reservoir.

10. Apparatus according to claim 7, wherein two helically wound grooves are provided which extend in opposite directions from the centre of the drum.

11. Apparatus according to claim 7, further including at least one drain orifice for removing processing solution from the vicinity of the drum.

12. Apparatus according to claim 7, wherein each helically wound groove is formed as a groove cut into the surface of the drum.

13. Apparatus according to claim 7, wherein each helically wound groove is formed as a raised portion on the surface of the drum.

* * * * *